US008588452B2

(12) United States Patent
Matsui et al.

(10) Patent No.: US 8,588,452 B2
(45) Date of Patent: Nov. 19, 2013

(54) MICROPHONE CAP AND MICROPHONE

(75) Inventors: Noriko Matsui, Tokyo (JP); Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 13/397,075

(22) Filed: Feb. 15, 2012

(65) Prior Publication Data

US 2012/0207336 A1 Aug. 16, 2012

(30) Foreign Application Priority Data

Feb. 15, 2011 (JP) ..... 2011-029416

(51) Int. Cl.
*H04R 25/00* (2006.01)

(52) U.S. Cl.
USPC ..... 381/361; 381/355; 381/357

(58) Field of Classification Search
USPC ..... 381/313, 355, 356, 357, 358, 359, 360, 381/361, 362; 379/420.03, 433.03
See application file for complete search history.

(56) References Cited

U.S. PATENT DOCUMENTS 4,463,222 A * 7/1984 Poradowski ..... 381/357
5,216,711 A * 6/1993 Takagi et al. ..... 379/433.03
6,151,399 A * 11/2000 Killion et al. ..... 381/313

FOREIGN PATENT DOCUMENTS

JP 2006-148325 6/2006

* cited by examiner

*Primary Examiner* — Huyen D Le
(74) *Attorney, Agent, or Firm* — Whitham Curtis Christofferson & Cook, PC

(57) ABSTRACT

A cap body 3 is provided for covering a housing of a microphone body 2. The cap body 3 has an insertion hole 32 into which the housing is inserted, sound collecting holes 31*a* and 31*b* through which the exterior of the cap body 3 is in communication with the insertion hole 32. While the housing is inserted into the insertion hole 32, a sound collector 21 lies in the insertion hole 32, and the axis line direction of the sound collecting holes 31*a* and 31*b* are different from the directive axis of the microphone body 2 of which the housing is inserted in the insertion hole 32.

10 Claims, 5 Drawing Sheets

MICROPHONE CAP AND MICROPHONE

TECHNICAL FIELD

The present invention relates to a microphone cap of which the direction of a directive axis is readily changeable from its exterior and a microphone provided with the microphone cap.

BACKGROUND ART

A directive microphone is installed to direct the directive axis of a microphone unit in the microphone toward an audio source for optimal sound collection. The directive axis of a microphone unit is usually directed toward the front of the microphone. In this case, the microphone is installed to direct the front of the microphone toward an audio source in order to direct the directive axis toward the audio source, and a cord extends opposite to the audio source (see Japanese Patent Laid-Open Publication No. 2006-148325).

FIG. 5 illustrates a typical known microphone having a directive axis toward the front. This microphone 1' includes a sound collector 21 at the front end of a body 2 of the microphone and a cord 22 extending from the rear end. The sound collector 21 includes a front sound collector 21*a* at the front end of the body 2 and a lateral sound collector 21*b* on a lateral wall close to the front end, and has a directive axis D' toward the front of the body 2.

In the case where the microphone 1' including the cord 22 on the opposite side to the audio source is used in order to collect voice of a speaker as the audio source in video broadcast such as television, the front of the microphone is directed toward the speaker while the long cord extends toward shooting equipment. This cord thereby appears in video images to impair the appearance of the images. Similarly, a boundary microphone on a desk used in, for example, a news program also has a cord extending from the rear end of a housing of the boundary microphone, which may cause this cord to appear in video images.

In use of such a microphone, the cord is required to be installed toward the audio source so as not to appear in video images.

SUMMARY OF INVENTION

Technical Problem

In order to solve the above problem, some microphones have microphone units attachable by turning 180 degrees such that the directive axis of the microphone unit has the same direction as that of the direction of an extending cord without changing the direction of extension of the cord.

Since such a microphone has a microphone unit fixed therein, it is necessary to remove screws on a housing and take out a built-in component including the microphone unit as a main element in order to change the direction of the microphone unit. This operation is troublesome and needs to touch the microphone unit. Additionally, hands of an operator or tools may contact with electronic boards or wires around the microphone unit during this operation, which may thereby cause a malfunction.

In order to solve this problem, some microphones can change only the direction of the extending cord without changing the direction of the microphone unit. In such microphones, operators do not need to directly contact with a microphone unit, which can thereby avoid the above malfunction. A microphone preferably employs, for example, a swage structure for a housing in order to satisfy a strong requirement for immunity of the microphone to radio-frequency interference (RFT) with, for example, the recent popularization of cellular phones. It is however difficult to employ a swage structure for such a microphone that can change only the direction of an extending cord.

In contrast, a microphone having a swage structure cannot change only the direction of an extending cord.

Some microphones are embedded in a hole on a ceiling or a desk for use. Since such a microphone is fixed so as to direct the directive axis toward an audio source, it is significantly difficult to change the direction of the directive axis after the microphone is fixed.

It is an object of the present invention to solve the above problems on typical known techniques, in other words, to provide a cap used in a microphone in which a user can change the direction of the directive axis without touching a microphone unit and that can employ a structure providing immunity of RFI such as a swage structure.

Solution to Problem

A microphone cap for covering a housing of a microphone body in accordance with the present invention includes a cap body to cover the housing, the cap body including an insertion hole into which the housing is inserted, and sound collecting holes through which the exterior of the cap body is in communication with the insertion hole, wherein a sound collector provided in the housing resides in the insertion hole while the housing is inserted into the insertion hole, and each direction of the axis lines of the sound collecting holes is different from the directive axis of the microphone body accommodated in the housing inserted in the insertion hole.

Advantageous Effects of Invention

The present invention provides a microphone in which a user can change the direction of the directive axis without touching a microphone unit and that can employ a structure providing immunity of RFI such as a swage structure.

DESCRIPTION OF EMBODIMENT

A microphone cap and a microphone in an embodiment of the present invention will now be described with reference to the accompanying drawings.

Figure 1:
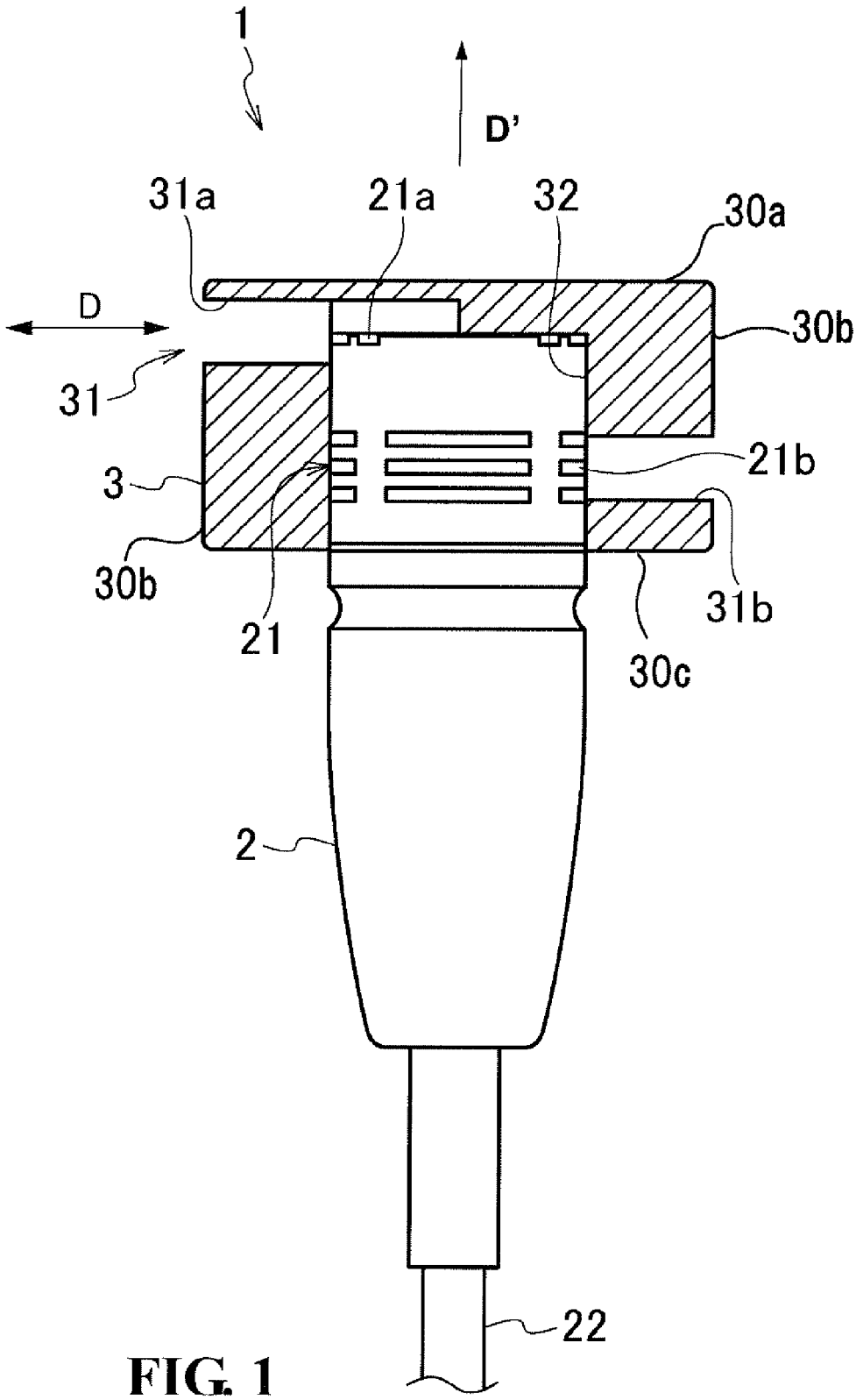
FIG. 1 is a cross-sectional view illustrating a microphone in accordance with an embodiment of the present invention.

As shown in FIG. 1, the microphone 1 of the invention includes a microphone body 2 and a microphone cap of the invention. The microphone cap has a cap body 3

Figure 4:
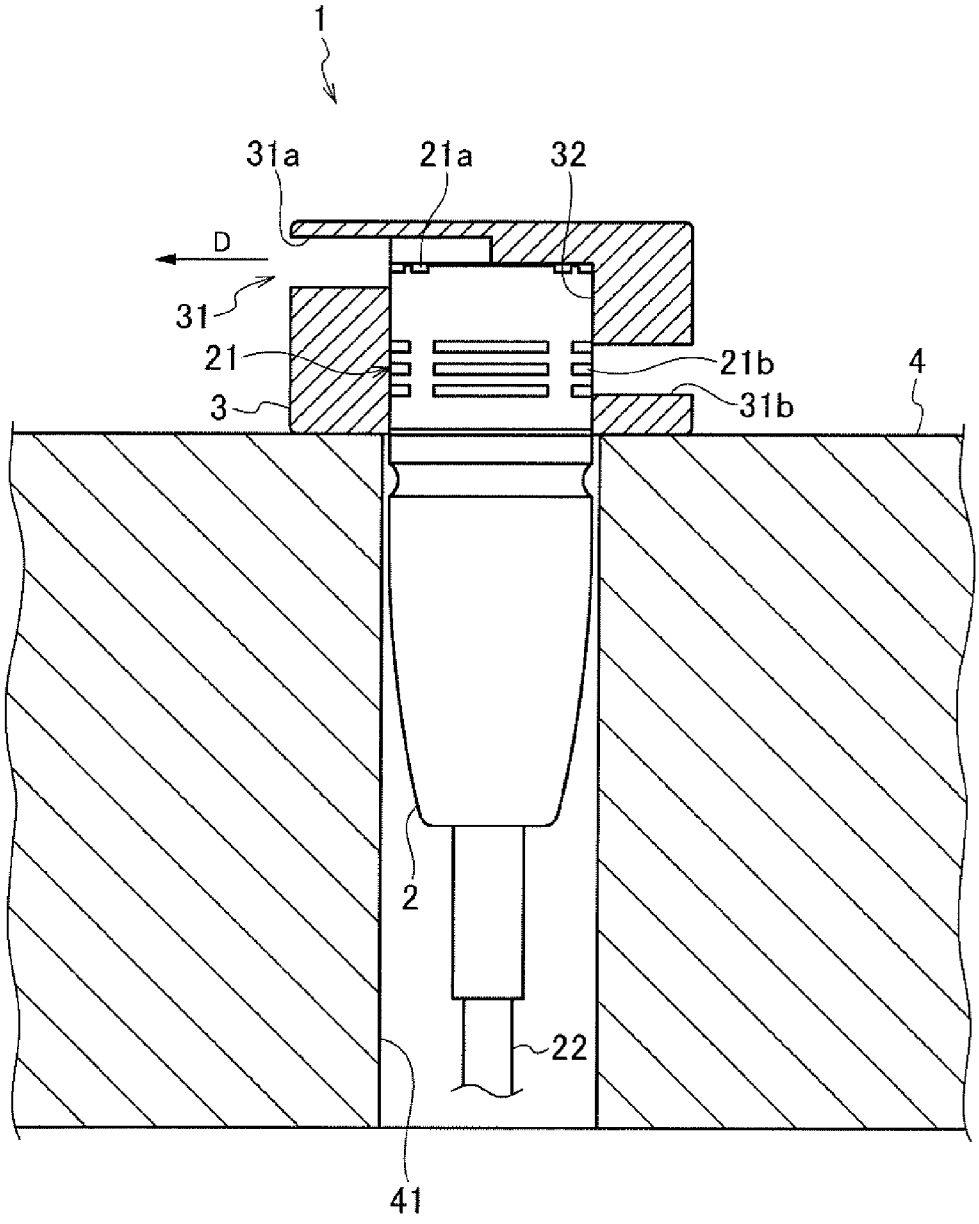
FIG. 4 is a cross-sectional view illustrating the microphone in FIG. 1 used as a boundary microphone embedded in a wall.
Figure 5:
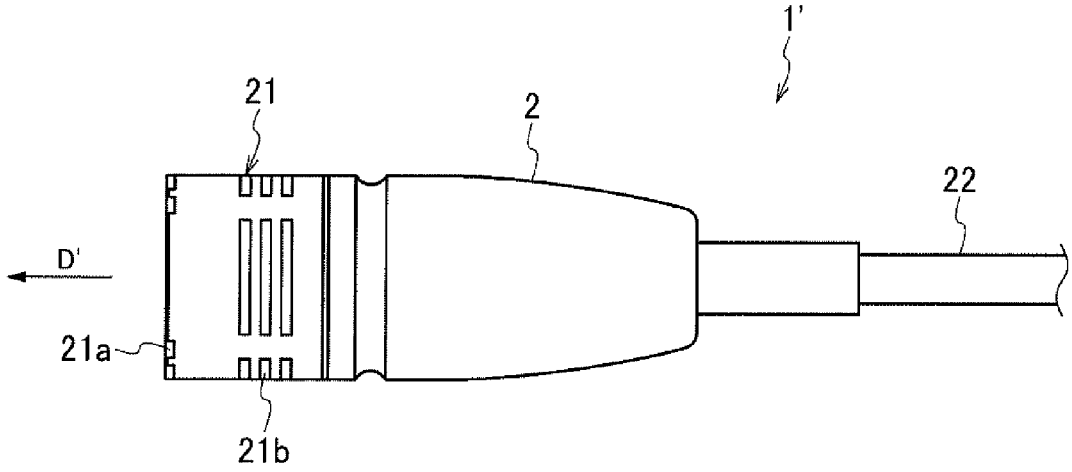
RELATED ART FIG. 5
FIG. 5 is a side view illustrating a typical known microphone.

The microphone body 2 is similar to a typical known microphone 1' shown in FIG. 4. The microphone body 2 includes a microphone unit (not shown in the drawing) in a substantially cylindrical housing and a sound collector 21 for introducing sound from its exterior to the microphone unit at the top end of the housing. The microphone unit converts sound into electrical signals and outputs the signals. A cord 22 extends from the opposite end of the housing to the sound collector 21. The sound collector 21 includes a front sound collector 21*a* at the front end of the microphone body 2 and a lateral sound collector 21*b* on a lateral wall close to the front end. Any electroacoustic transducer can be used for the microphone unit. For example, a condenser microphone unit may be used. The microphone unit has unidirectional characteristics.

A hollow cylindrical cap body 3 covers the front of the sound collector 21 in the microphone body 2 and rotatably fits to the microphone body 2. The cap body 3 includes sound collecting holes 31 for introducing sound from its exterior to the sound collector 21 of the microphone body 2 and an insertion hole 32 for inserting the housing of the microphone body 2.

The cap body 3 is a cylinder consisting of an upper base face 30*a* (correspond to a base of the present invention) covering the front face of the sound collector 21 (the front end of the housing of the microphone body 2 inserted in the insertion hole 32), a side wall 30*b* covering the side wall of the housing of the microphone body 2, and a lower base face 30*c* opposite to the upper base face 30*a*.

The insertion hole 32 extends from the lower base face 30*c* to the upper base face 30*a*. The shape of the hole can accept the housing of the microphone body 2. While the housing of the microphone body 2 is inserted into the insertion hole 32, the sound collector resides in the insertion hole 32.

Figure 2A:
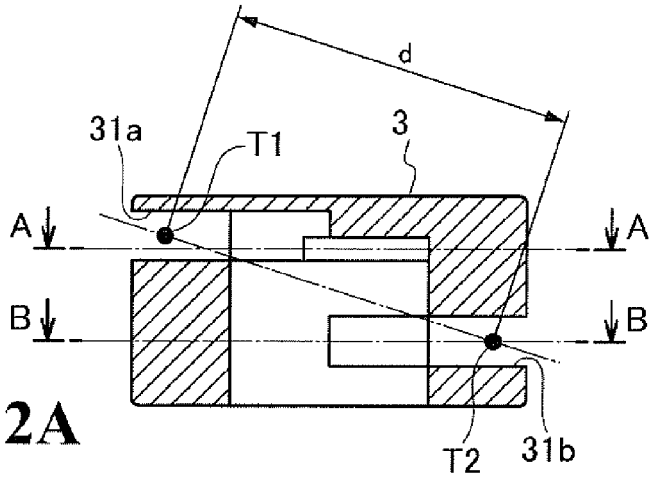
FIG. 2A is a longitudinal cross-sectional view illustrating a microphone cap constituting the microphone in the embodiment.
Figure 2B:
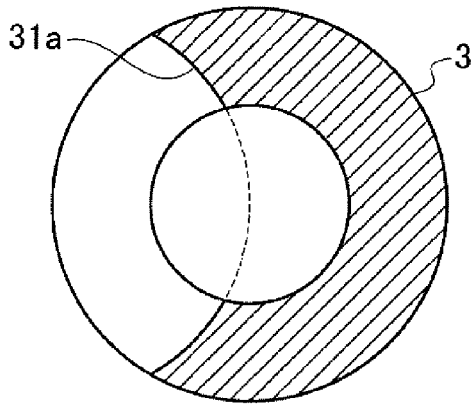
FIG. 2B is a cross-sectional view illustrating the cap taken from line A-A of FIG. 2A.
Figure 2C:
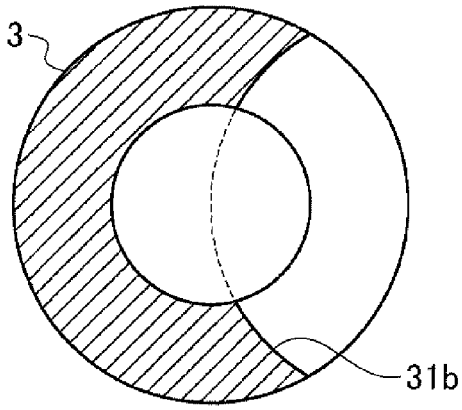
FIG. 2C is a cross-sectional view illustrating the cap taken from line B-B of FIG. 2A.

The sound collecting holes 31*a* and 31*b* are provided in the side wall 30*b* through which the exterior of the cap body 3 is in communication with the insertion hole 32. While the microphone body 2 is covered by the cap body 3, the sound collector 21 is in communication with the exterior of the cap body 3 through the sound collecting holes 31*a* and 31*b*. In this embodiment, the sound collecting holes 31*a* and 31*b* are open in the different directions from each other along the directive axis of the microphone body 2. As shown in FIGS. 2B and 2C, the sound collecting holes 31*a* and 31*b* are located at 180 degrees to each other with respect to the axial direction of the cap body 3 (front face in the drawings in FIGS. 2B and 2C), i.e., opposite to each other with respect to the axial line center of the cap body 3 in a cross-section viewed from the axial line of the cap body 3. As shown in FIGS. 1 and 2A, the sound collecting holes 31*a* and 31*b* are located on different planes orthogonal to the axial line direction of the cap body 3, and have a direction substantially orthogonal to a directive axis D' of the microphone body 2.

The directions of the openings of the sound collecting holes 31*a* and 31*b* are ones viewed from the central axis line of the cap body 3 in a cross-section viewed from the axis line of the cap body 3.

The sound collecting hole 31*a* is closer to the top end of the microphone 1 than the sound collecting hole 31*b* and communicates with the bottom of the insertion hole 32 so as to introduce sound from the exterior of the cap body 3 to the front sound collector 21*a* of the microphone body 2. FIG. 2B is a cross-sectional view illustrating the sound collecting hole 31*a* taken from line A-A of FIG. 2A along a plane orthogonal to the axial direction of the cap body 3. As shown in FIG. 2B, the sound collecting hole 31*a* has an opening that expands from the interior toward the exterior of the cap body 3, which can thereby collect sound from a wide range.

The sound collecting hole 31*b* is closer to the rear end of the microphone 1 than the sound collecting hole 31*a* and communicates with an opening of the insertion hole 32 so as to introduce sound from the exterior of the cap body 3 to the lateral sound collector 21*b* of the microphone body 2. FIG. 2C is a cross-sectional view illustrating the sound collecting hole 31*b* taken from line B-B of FIG. 2A along a plane orthogonal to the axial direction of the cap body 3. As shown in FIG. 2C, the sound collecting hole 31*b* has an opening that expands from the interior toward the exterior of the cap body 3, which can thereby collect sound from a wide range.

Figure 3:
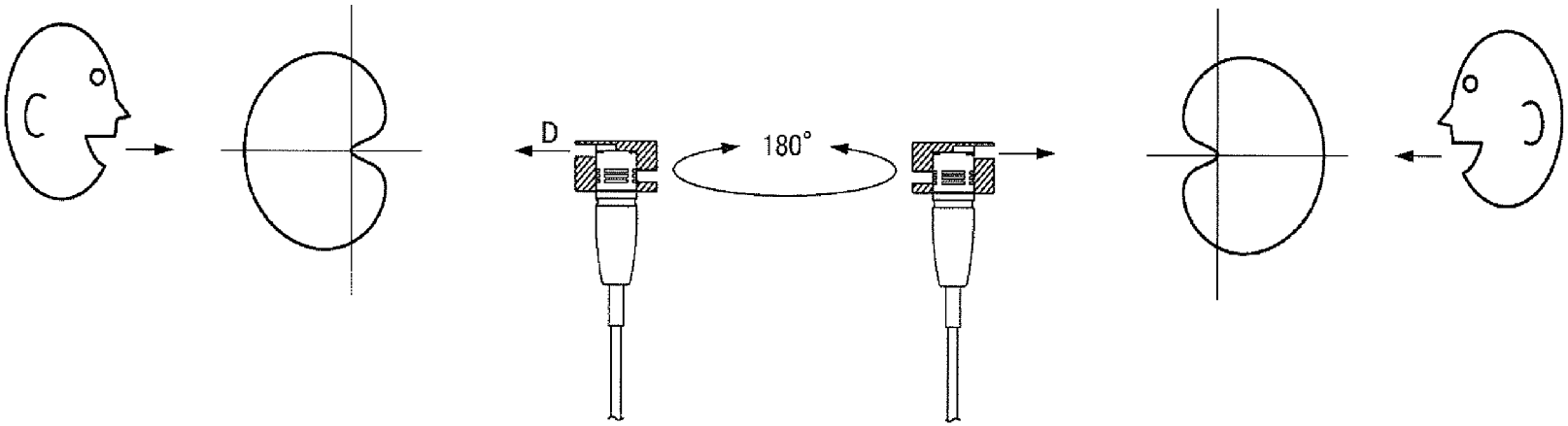
FIG. 3 is a longitudinal cross-sectional view illustrating adjustment of the direction of the directive axis of the microphone in FIG. 1 and graphs illustrating directive characteristic lines.

The microphone 1 including the cap body 3 has an acoustic center-point in the center near the open end of the sound collecting hole 31*a* of the cap body 3 as shown in FIG. 2A. This acoustic center-point is referred to as a front acoustic terminal T1. Similarly, the microphone 1 has another acoustic center-point in the center near the open end of the sound collecting hole 31*b*. This acoustic center-point is referred to as a rear acoustic terminal T2. The difference in acoustic pressure between these acoustic terminals T1 and T2 defines the directive axis of the microphone 1. This directive axis has the same direction as that of a line joining the acoustic terminals T1 and T2. Since the acoustic terminal T1 has a locational difference from the acoustic terminal T2 in the longitudinal or anteroposterior direction of the microphone 1, the directive axis of the microphone 1 is not perfectly orthogonal to the original directive axis of the microphone 1. However, for the small locational difference, the directive axis of the microphone 1 is substantially orthogonal to the original directive axis. The directive axis of the microphone 1 including the cap body 3 has substantially the same direction as that indicated by an arrow D in FIG. 1. This directive axis significantly depends on the direction of the sound collecting hole 31*a* in this embodiment. The cap body 3 can therefore be rotated as shown in FIG. 3 so as to readily change the direction of the sound collecting hole 31*a*, i.e., the direction of the directive axis.

For the microphone unit having unidirectional characteristics, the microphone 1 has substantially unidirectional characteristics when a straight-line distance d (see FIG. 2A) between the acoustic terminals T1 and T2 is shortened by changing the diameter of the cap body 3 and has substantially sharp directivity when the straight-line distance d is lengthened.

In the present invention, the sound collecting hole(s) 31 may be provided at more than two locations, which can be determined appropriately. Such appropriate positioning of the sound collecting holes 31 can facilitate the adjustment of the directivity.

The microphone in this embodiment can also be suitable for a boundary microphone embedded in a ceiling, a wall, or the top of a desk for use.

An example of such a boundary microphone is shown in FIG. 4. The microphone 1 in FIG. 4 is the same as the microphone 1 in the preceding embodiment and is fixed in an insertion hole 41 on a wall 4 with a cap body 3 exposed to the exterior of the wall 4. In other words, the microphone 1 other than a sound collector 21 of the microphone body 2 is embedded in the wall 4 so as to function as a boundary microphone.

After a typical known boundary microphone to be embedded is fixed, it is significantly difficult to change the direction of its directive axis. In contrast, in the boundary microphone of this embodiment, the direction of the directive axis can be readily changed by rotation of the cap body 3.

The microphones of the embodiments does not require a change in the direction of the microphone unit in order to adjust the direction of the directive axis, and its body can thus employ a structure providing immunity of RFI such as a swage structure.

What is claimed is:

1. A microphone cap for covering a housing of a microphone body, comprising:

a cylindrical cap body covering the housing, the cylindrical cap body having:

a cylindrical insertion hole for inserting the housing; and a plurality of sound collecting holes through which an exterior of the cylindrical cap body is in communication with the cylindrical insertion hole, wherein the microphone body comprises a sound collector provided in the housing which resides in the cylindrical insertion hole while the housing is inserted into the cylindrical insertion hole, wherein each of the plurality of sound collecting holes is open in different directions from each other, wherein the housing is cylindrical and is rotatable while inserted in the cylindrical insertion hole, and wherein a directive axis of the microphone body accommodated in the housing while inserted in the cylindrical insertion hole is changed by rotation of the cylindrical cap body.

2. The microphone cap according to claim 1, wherein the housing has a base, wherein each of the plurality of sound collecting holes is provided on a side wall constituting the cylindrical cap body, and wherein the base constituting the cylindrical cap body is disposed on a leading end of the housing inserted in the cylindrical insertion hole.

3. The microphone cap according to claim 1, wherein each of the plurality of sound collecting holes reside at different positions along a direction of the directive axis of the microphone body.

4. The microphone cap according to claim 1, wherein the plurality of sound collecting holes comprises two sound collecting holes that are disposed opposite to each other with respect to a central axis line of the cylindrical cap body in a cross-section viewed from an axis line of the cylindrical cap body.

5. The microphone cap according to claim 1, wherein the plurality of sound collecting holes expands from an interior toward an exterior of the cylindrical cap body.

6. A microphone comprising:

a microphone body having a housing;

a cylindrical cap body covering the housing of the microphone body, the cylindrical cap body having:

a cylindrical insertion hole for inserting the housing; and a plurality of sound collecting holes through which an exterior of the cap body is in communication with the cylindrical insertion hole;

a sound collector provided in the housing resides in the cylindrical insertion hole while the housing is inserted into the cylindrical insertion hole; and a directive axis of the microphone body accommodated in the housing inserted in the cylindrical insertion hole, wherein each of the plurality of sound collecting holes is open in different directions from each other, wherein the housing is cylindrical and is rotatable while inserted in the cylindrical insertion hole, and wherein the directive axis of the microphone body accommodated in the housing while inserted in the cylindrical insertion hole is changed by rotation of the cylindrical cap body.

7. The microphone according to claim 6, wherein the housing has a base, wherein each of the plurality of sound collecting holes is provided on a side wall constituting the cylindrical cap body, and wherein the base constituting the cylindrical cap body is disposed on a the leading end of the housing inserted in the cylindrical insertion hole.

8. The microphone according to claim 6, wherein each of the plurality of sound collecting holes reside at different positions along a direction of the directive axis of the microphone body.

9. The microphone according to claim 6, wherein the plurality of sound collecting holes comprises two sound collecting holes that are disposed opposite to each other with respect to a central axis line of the cylindrical cap body in a cross-section viewed from an axis line of the cylindrical cap body.

10. The microphone according to claim 6, wherein the plurality of sound collecting holes expands from an interior toward an exterior of the cylindrical cap body.

* * * * *

UNITED STATES PATENT AND TRADEMARK OFFICE

CERTIFICATE OF CORRECTION

PATENT NO. : 8,588,452 B2
APPLICATION NO. : 13/397075
DATED : November 19, 2013
INVENTOR(S) : Matsui et al.

It is certified that error appears in the above-identified patent and that said Letters Patent is hereby corrected as shown below:

In the Claims

Column 6, Claim 7, line 31, after "disposed on a" delete "the" (first occurrence)

Signed and Sealed this
First Day of April, 2014

Michelle K. Lee

Michelle K. Lee
*Deputy Director of the United States Patent and Trademark Office*